US006207334B1

(12) United States Patent
Dinh et al.

(10) Patent No.: US 6,207,334 B1
(45) Date of Patent: Mar. 27, 2001

(54) PHOTORECEPTOR WITH IMPROVED COMBINATION OF OVERCOAT LAYER AND CHARGE TRANSPORT LAYER

(75) Inventors: Kenny-tuan T. Dinh, Webster; Timothy J. Fuller, Pittsford; Markus R. Silvestri, Fairport; Paul J. Defeo, Sodus Point; Damodar M. Pai, Fairport; John F. Yanus, Webster; Robert W. Nolley, deceased, late of Rochester, all of NY (US), by Vivian D. Nolley, heir

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/570,286

(22) Filed: May 12, 2000

(51) Int. Cl.[7] ..... G03G 5/047

(52) U.S. Cl. ..... 430/58.8; 430/58.05; 430/58.4; 430/59.6; 430/132; 430/58.75

(58) Field of Search ..... 430/58.05, 58.8, 430/59.6, 132

(56) References Cited

U.S. PATENT DOCUMENTS

| | | | | |
|---|---|---|---|---|
| 4,050,935 | | 9/1977 | Limburg et al. | 430/58.3 |
| 4,281,054 | | 7/1981 | Horgan et al. | 430/57.8 |
| 4,297,425 | | 10/1981 | Pai et al. | 430/58.8 |
| 4,457,994 | | 7/1984 | Pai et al. | 430/57.8 |
| 4,599,286 | | 7/1986 | Limburg et al. | 430/58.65 |
| 4,752,549 | * | 6/1988 | Otsuka et al. | 430/59.6 |
| 4,871,634 | | 10/1989 | Limburg et al. | 430/58.6 |
| 5,135,834 | * | 8/1992 | Hanatani et al. | 430/132 |
| 5,368,967 | | 11/1994 | Schank et al. | 430/58.3 |
| 5,418,107 | | 5/1995 | Nealey et al. | 430/132 |
| 5,681,679 | | 10/1997 | Schank et al. | 430/58.2 |
| 5,702,854 | | 12/1997 | Schank et al. | 430/117 |
| 5,709,974 | | 1/1998 | Yuh et al. | 430/126 |
| 5,976,744 | | 11/1999 | Fuller et al. | 430/58.8 |
| 6,004,709 | | 12/1999 | Renfer et al. | 430/58.65 |
| 6,139,999 | * | 10/2000 | Fuller et al. | 430/59.6 |

* cited by examiner

*Primary Examiner*—Roland Martin
(74) *Attorney, Agent, or Firm*—Oliff & Berridge, PLC

(57) ABSTRACT

An electrophotographic imaging member including
- a substrate,
- a charge generating layer,
- a charge transport layer, and
- an overcoat layer including
  - a polyvinyl butyral film forming binder,
  - a cross linked polyamide film forming binder, and
  - a hole transport material.

A process for forming an overcoated imaging member is also disclosed.

24 Claims, No Drawings

PHOTORECEPTOR WITH IMPROVED COMBINATION OF OVERCOAT LAYER AND CHARGE TRANSPORT LAYER

BACKGROUND OF THE INVENTION

This invention relates in general to electrophotographic imaging members and, more specifically, to layered photoreceptor structures with improved combination of overcoat layer and charge transport layer and processes for making and using the imaging members.

Electrophotographic imaging members, i.e. photoreceptors, typically include a photoconductive layer formed on an electrically conductive substrate. The it photoconductive layer is an insulator in the dark so that electric charges are retained on its surface. Upon exposure to light, the charge is dissipated.

Many advanced imaging systems are based on the use of small diameter photoreceptor drums. The use of small diameter drums places a premium on photoreceptor life. A major factor limiting photoreceptor life in copiers and printers, is wear. The use of small diameter drum photoreceptors exacerbates the wear problem because, for example, 3 to 10 revolutions are required to image a single letter size page. Multiple revolutions of a small diameter drum photoreceptor to reproduce a single letter size page can require up to 1 million cycles from the photoreceptor drum to obtain 100,000 prints, a desirable goal for commercial systems.

For low volume copiers and printers, bias charging rolls (BCR) are desirable because little or no ozone is produced during image cycling. However, the micro corona generated by the BCR during charging, damages the photoreceptor, resulting in rapid wear of the imaging surface, e.g., the exposed surface of the charge transport layer. For example wear rates can be as high as about 16$\mu$ per 100,000 imaging cycles. Similar problems are encountered with bias transfer roll (BTR) systems. One approach to achieving longer photoreceptor drum life is to form a protective overcoat on the imaging surface, e.g. the charge transporting layer of a photoreceptor. This overcoat layer must satisfy many requirements, including transporting holes, resisting image deletion, resisting wear, avoidance of perturbation of underlying layers during coating. Although various hole transporting small molecules can be used in overcoating layers, one of the toughest overcoatings discovered comprises cross linked polyamide (e.g. Luckamide) containing N,N'-diphenyl-N,N'-bis(3-hydroxyphenyl)-[1,1'-biphenyl]-4,4'-diamine. This tough overcoat is described in U.S. Pat. No. 5,368,967, the entire disclosure thereof being incorporated herein by reference.

Durable photoreceptor overcoatings containing cross linked polyamide (e.g. Luckamide) containing N,N'-diphenyl-N,N'-bis(3-hydroxyphenyl)-[1,1'-biphenyl]-4,4'-diamine (DHTBD) [Luckamide-DHTBD] have been prepared using oxalic acid and trioxane to improve photoreceptor life by at least a factor of 3 to 4. Such improvement in the bias charging roll (BCR) wear resistance involved crosslinking of Luckamide under heat treatment, e.g. 110° C.–120° C. for 30 minutes. However, adhesion of this overcoat to certain photoreceptor charge transport layers, containing certain polycarbonates (e.g., Z-type 300) and charge transport materials [e.g., bis-N,N-(3,4-dimethylphenyl)-N-(4-biphenyl )amine and N,N'-diphenyl-N,N'-bis(3-methylphenyl)-[1,1'-biphenyl]-4,4'-diamine] is greatly reduced under such drying conditions. On the other hand, under drying conditions of below about 110° C., the overcoat adhesion to the charge transport layer was good, but the overcoat had a high rate of wear. Thus, there was an unacceptably small drying conditions window for is the overcoat to achieve the targets of both adhesion and wear rate. Another shortcoming of the prior art is the very low charge carrier mobilities in the overcoat. If the charge carrier mobility is low, the charge carriers (created during the exposure step) that have transited through the transport layer might still be in transit in the overcoat by the time the exposed region of the photoreceptor arrives at the development subsystem. This results in higher Photoinduced discharge Characteristic (PIDC) tail voltages. PIDC is the plot of the potential versus the exposure. PIDC tail is the voltage remaining on the photoreceptor at higher exposure levels. Maximum discharge is observed if the photogenerated carriers (created during the exposure step) transit the transport layer and the overcoat layer. To the extent the carriers are still in transit, lower discharge results for a given exposure. Therefore, in order to achieve maximum discharge with lower mobility material in the overcoat, the overcoat thickness has to be small. Small thickness limits the wear life of the overcoating. In order to increase life, it is necessary to reduce wear rates and increase the overcoat thickness. Thicker overcoats require higher mobilities in order to accomplish maximum discharge for a given exposure.

INFORMATION DISCLOSURE STATEMENT

U.S. Pat. No. 5,702,854 to Schank et al., issued Dec. 30, 1998—An electrophotographic imaging member is disclosed including a supporting substrate coated with at least a charge generating layer, a charge transport layer and an overcoating layer, said overcoating layer comprising a dihydroxy arylamine dissolved or molecularly dispersed in a crosslinked polyamide matrix. The overcoating layer is formed by crosslinking a crosslinkable coating composition including a polyamide containing methoxy methyl groups attached to amide nitrogen atoms, a crosslinking catalyst and a dihydroxy amine, and heating the coating to crosslink the polyamide. The electrophotographic imaging member may be imaged in a process involving uniformly charging the imaging member, exposing the imaging member with activating radiation in image configuration to form an electrostatic latent image, developing the latent image with toner particles to form a toner image, and transferring the toner image to a receiving member.

U.S. Pat. No. 5,681,679 issued to Schank, et al. on Oct. 28, 1997—A flexible electrophotographic imaging member is disclosed including a supporting substrate and a resilient combination of at least one photoconductive layer and an overcoating layer, the at least one photoconductive layer comprising a hole transporting arylamine siloxane polymer and the overcoating comprising a crosslinked polyamide doped with a dihydroxy amine. This imaging member may be utilized in an imaging process including forming an electrostatic latent image on the imaging member, depositing toner particles on the imaging member in conformance with the latent image to form a toner image, and transferring the toner image to a receiving member.

U.S. Pat. No. 6,004,709, issued to Renfer et al, on Dec. 21, 1999—An allyloxypolyamide composition is disclosed, the allyloxypolyamide being represented by a specific formula. The allyloxypolyamide may be synthesized by reacting an alcohol soluble polyamide with formaldehyde and an allylalcohol. The allyloxypolyamide may be cross linked by a process selected from the group consisting of (a) heating an allyloxypolyamide in the presence of a free radical catalyst, and (b) hydrosilation of the double bond of the allyloxy group of the allyloxypolyamide with a silicon hydride reactant having at least 2 reactive sites.

A preferred article comprises a substrate, at least one photoconductive layer, and an overcoat layer comprising a hole transporting hydroxy arylamine compound having at least two hydroxy functional groups, and a cross linked allyloxypolyamide film forming binder.

A stabilizer may be added to the overcoat.

U.S. Pat. No. 5,976,744 issued to Fuller et al. on Nov. 2, 1999—An electrophotographic imaging member is disclosed including a supporting substrate coated with at least one photoconductive layer, and an overcoating layer, the overcoating layer including a a hydroxy functionalized aromatic diamine and a hydroxy functionalized triarylamine dissolved or molecularly dispersed in a crosslinked acrylated polyamide matrix, the hydroxy functionalized triarylamine being a compound different from the polyhydroxy functionalized aromatic diamine, the crosslinked polyamide prior to crosslinking being selected from the group consisting of materials represented by the following Formulae I and II:

I

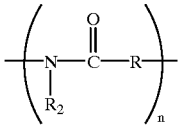

wherein:

n is a positive integer sufficient to achieve a weight average molecular weight between about 5000 and about 100,000, R is an alkylene group containing from 1 to 10 carbon atoms, between 1 and 99 percent of the $R_2$ sites are

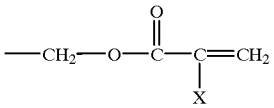

wherein X is selected from the group consisting of —H (acrylate), —$CH_3$ (methacrylate), alkyl and aryl, and the remainder of the $R_2$ sites are selected from the group consisting of —H, —$CH_2OCH_3$, and —$CH_2OH$, and

II

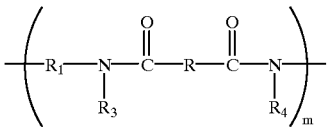

wherein:

m is a positive integer sufficient to achieve a weight average molecular weight between about 5000 and about 100000, R and $R_1$ are independently selected from the group consisting of alkylene units containing from 1 to 10 carbon atoms;

between 1 and 99 percent of $R_3$ and $R_4$ are independently selected from the group consisting of

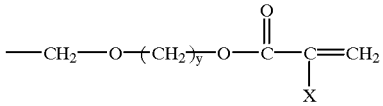

wherein

X is selected from the group consisting of hydrogen, alkyl, aryl and alkylaryl, wherein the alkyl groups contain 1 to 10 carbon atoms and the aryl groups contain 1 to 3 alkyl groups, y is an integer between 1 and 10, and the remainder of the $R_3$ and $R_4$ groups are selected from the group consisting of —H, —$CH_2OH$, —$CH_2OCH_3$, and —$CH_2OC(O)$—$C(X)$=$CH_2$.

The overcoating layer is formed by coating. The electrophotographic imaging member may be imaged in a process.

U.S. Pat. No. 5,709,974 issued to Yuh, et al. on Jan. 20, 1998—An electrophotographic imaging member including a charge generating layer, a charge transport layer and an overcoating layer, the transport layer including a charge transporting aromatic diamine molecule in a polystyrene matrix and the overcoating layer including a hole transporting hydroxy arylamine compound having at least two hydroxy functional groups and a polyamide film forming binder capable of forming hydrogen bonds with the hydroxy functional groups of the hydroxy arylamine compound. This imaging member is utilized in an imaging process.

U.S. Pat. No. 5,368,967 issued to Schank et al. on Nov. 29, 1994—An electrophotographic imaging member is disclosed comprising a substrate, a charge generating layer, a charge transport layer, and an overcoat layer comprising a small molecule hole transporting arylamine having at least two hydroxy functional groups, a hydroxy or multihydroxy triphenyl methane and a polyamide film forming binder capable of forming hydrogen bonds with the hydroxy functional groups the hydroxy arylamine and hydroxy or multihydroxy triphenyl methane. This overcoat layer may be fabricated using an alcohol solvent. This electrophotographic imaging member may be utilized in an electrophotographic imaging process. Specific materials including Elvamide polyamide and N,N'-diphenyl-N,N'-bis(3-hydroxyphenyl)-[1,1'-biphenyl]-4,4'-diamine and bis-[2-methyl-4-(N-2-hydroxyethyl-N-ethyl-aminophenyl)]-phenylmethane are disclosed in this patent.

U.S. Pat. No. 4,871,634 to Limburg et al., issued Oct. 3, 1989—An electrostatographic imaging member is disclosed which contains at least one electrophotoconductive layer, the imaging member comprising a photogenerating material and a hydroxy arylamine compound represented by a certain formula. The hydroxy arylamine compound can be used in an overcoating with the hydroxy arylamine compound bonded to a resin capable of hydrogen bonding such as a polyamide possessing alcohol solubility.

U.S. Pat. No. 4,297,425 to Pai et al., issued Oct. 27, 1981—A layered photosensitive member is disclosed comprising a generator layer and a transport layer containing a combination of diamine and triphenyl methane molecules dispersed in a polymeric binder.

U.S. Pat. No. 4,050,935 to Limburg et al., issued Sep. 27, 1977—A layered photosensitive member is disclosed comprising a generator layer of trigonal selenium and a transport layer of bis(4-diethylamino-2-methylphenyl) phenylmethane molecularly dispersed in a polymeric binder.

U.S. Pat. No. 4,457,994 to Pai et al. et al, issued Jul. 3, 1984—A layered photosensitive member is disclosed comprising a generator layer and a transport layer containing a diamine type molecule dispersed in a polymeric binder and an overcoat containing triphenyl methane molecules dispersed in a polymeric binder.

U.S. Pat. No. 4,281,054 to Horgan et al., issued Jul. 28, 1981—An imaging member is disclosed comprising a substrate, an injecting contact, or hole injecting electrode overlying the substrate, a charge transport layer comprising an electrically inactive resin containing a dispersed electrically active material, a layer of charge generator material and a layer of insulating organic resin overlying the charge generating material. The charge transport layer can contain triphenylmethane.

U.S. Pat. No. 4,599,286 to Limburg et al., issued Jul. 8, 1982—An electrophotographic imaging member is disclosed comprising a charge generation layer and a charge transport layer, the transport layer comprising an aromatic amine charge transport molecule in a continuous polymeric binder phase and a chemical stabilizer selected from the group consisting of certain nitrone, isobenzofuran, hydroxyaromatic compounds and mixtures thereof. An electrophotographic imaging process using this member is also described.

U.S. Pat. No. 5,418,107 to Nealey et al., issued May 23, 1995—A process is disclosed for fabricating an electrophotographic imaging member including providing a substrate to be coated, forming a coating comprising photoconductive pigment particles having an average particle size of less than about 0.6 micrometer dispersed in a solution of a solvent comprising n-alkyl acetate having from 3 to 5 carbon atoms in the alkyl group and a film forming polymer consisting essentially of a film forming polymer having a polyvinyl butyral content between about 50 and about 75 mol percent, a polyvinyl alcohol content between about 12 and about 50 mol percent, and a polyvinyl acetate content is between about 0 to 15 mol percent, the photoconductive pigment particles including a mixture of at least two different phthalocyanine pigment particles free of vanadyl phthalocyanine pigment particles, drying the coating to remove substantially all of the alkyl acetate solvent to form a dried charge generation layer comprising between about 50 percent and about 90 percent by weight of the pigment particles based on the total weight of the dried charge generation layer, and forming a charge transport layer.

CROSS REFERENCE TO COPENDING APPLICATIONS

U.S. patent application Ser. No. 09/570,601 filed in the names of K. Dinh et al., entitled "PHOTORECEPTOR WITH IMPROVED OVERCOAT LAYER", filed concurrently herewith—An electrophotographic imaging member is disclosed including a substrate, a charge generating layer, a charge transport layer, and an overcoat layer including a first polyamide film forming binder free of methyl methoxy groups, an optional second polyamide film forming binder containing methyl methoxy groups, and a hole transport material.

A process for forming an overcoated imaging member is also disclosed.

U.S. patent application Ser. No. 09/218,928 filed in the names of Renfer et al., entitled "IMPROVED STABILIZED OVERCOAT COMPOSITIONS", filed on Dec. 22, 1998, now U.S. Pat. No. 6,071659, —An electrophotographic imaging member is disclosed including a substrate, a charge generating layer, a charge transport layer, and an overcoat layer including a hole transporting hydroxy arylamine compound having at least two hydroxy functional groups, bis-(2-methyl-4-diethylaminophenyl)-phenylmethane and a cross linked polyamide film forming binder.

A process for forming an overcoated imaging member is also disclosed.

U.S. patent application Ser. No. 09/182,602 filed in the names of Yanus et al., entitled "OVERCOATING COMPOSITIONS, OVERCOATED PHOTORECEPTORS, AND METHODS OF FABRICATING AND USING OVERCOATED PHOTORECEPTORS", filed on Oct. 29, 1998, now U.S. Pat. No. 6,103,436, —An electrophotographic imaging member is disclosed including a supporting substrate coated with at least photoconductive layer, a charge transport layer and an overcoating layer, the overcoating layer including a hydroxy functionalized aromatic diamine and a hydroxy functionalized triarylamine dissolved or molecularly dispersed in a crosslinked polyamide matrix, the crosslinked polyamide prior to crosslinking being selected from the group consisting of materials represented by the following Formulae I and II:

I

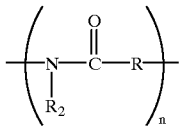

wherein:

n is a positive integer sufficient to achieve a weight average molecular weight between about 5000 and about 100,000, R is an alkylene unit containing from 1 to 10 carbon atoms, between 1 and 99 percent of the $R_2$ sites are —H, and the remainder of the $R_2$ sites are —$CH_2$—O—$CH_3$, and

II

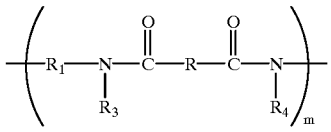

wherein:

m is a positive integer sufficient to achieve a weight average molecular weight between about 5000 and about 100000, $R_1$ and R are independently selected from the group consisting of alkylene units containing from 1 to 10 carbon atoms, and between 1 and 99 percent of the $R_3$ and $R_4$ sites are —H, and the remainder of the $R_3$ and $R_4$ sites are —$CH_2$—O—$CH_3$.

Coating compositions for the overcoating layer of this invention as well as methods of making and using the overcoated photoreceptor are also disclosed.

U.S. patent application Ser. No. 09/450,196 filed in the names of Yanus et al titled CROSS LINKED POLY AMIDE ANTICURL BACK COATING FOR ELECTROSTATOGRAPHIC IMAGING MEMBERS—A flexible electrostatographic imaging member is disclosed including at least one photographic imaging layer, a support layer, and an anticurl back layer having an exposed surface including a cross linked polyamide at the exposed surface, the polyamide being, formed from a solution selected from the group including a first solution including crosslinkable alcohol soluble polyamide containing methoxy methyl groups attached to amide nitrogen atoms, an acid having a $pK_a$ less than about 3, a cross linking agent selected from the group including a formaldehyde generating cross linking agent, an alkoxylated cross linking agent, a methylolamine cross linking agent and mixtures thereof, and a liquid selected from the group including alcohol solvents, diluent and mixtures thereof, a second solution including crosslinkable alcohol soluble polyamide free of methoxy methyl groups attached to amide nitrogen atoms, an acid having a $pK_a$ less than about 3, a cross linking agent selected from the group including a an alkoxylated cross linking agent, a methylolamine cross linking agent and mixtures thereof, and a liquid selected from the group including alcohol solvents, diluent and mixtures thereof.

U.S. patent application Ser. No. 09/450,189 filed in the names of Yanus et al CROSS LINKED PHENOXY ANTICURL BACK COATING FOR ELECTROSTATOGRAPHIC IMAGING MEMBERS—A flexible electrostatographic imaging member is disclosed including at least one photographic imaging layer, a support layer, and an anticurl back layer having an exposed surface including a cross linked phenoxy resin at the exposed surface, the phenoxy resin being formed from a solution including cross linkable solvent soluble phenoxy resin containing hydroxyl groups attached to carbon atoms, an acid having a $pK_a$ less than about 3, a cross linking agent selected from the group including a formaldehyde generating cross linking agent, an alkoxylated cross linking agent, a methylolamine cross linking agent and mixtures thereof, and a liquid selected from the group including solvents, diluent and mixtures thereof.

BRIEF SUMMARY OF THE INVENTION

It is, therefore, an object of the present invention to provide an improved electrophotographic imaging member and process for fabricating the member.

It is another object of the present invention to provide an improved imaging member that has improved adhesion to the transport layer.

It is still another object of the present invention to provide an improved imaging member that has higher charge carrier mobilities.

It is yet another object of the present invention to provide an improved imaging member that has a thicker overcoat layer that does not alter the Photo Induced Discharge Characteristics (PIDC).

It is another object of the present invention to provide an improved imaging member overcoated with a tough overcoating which resists wear.

It is another object of the present invention to provide an improved imaging member that has higher wear life resulting from thicker overcoat layers and reduced wear rates.

The foregoing objects and others are accomplished in accordance with this invention by providing an electrophotographic imaging member comprising a substrate, a charge generating layer, a charge transport layer, and an overcoat layer comprising a polyvinyl butyral film forming binder, a cross linked polyamide film forming binder, and a hole transporting molecule.

The electrophotographic imaging member may be fabricated by forming a coating solution comprising an alcohol miscible nonalcoholic solvent, a hole transporting material, an alcohol, a polyvinyl butyral film forming binder, and a cross linkable polyamide film forming binder, forming a coating with the coating solution on a photoreceptor comprising a charge generating layer and a charge transport layer, and drying the coating and cross linking the polyamide to form an overcoating layer.

Electrophotographic imaging members are well known in the art. Electrophotographic imaging members may be prepared by any suitable technique. Typically, a flexible or rigid substrate is provided with an electrically conductive surface. A charge generating layer is then applied to the electrically conductive surface. A charge blocking layer may optionally be applied to the electrically conductive surface prior to the application of a charge generating layer. If desired, an adhesive layer may be utilized between the charge blocking layer and the charge generating layer. Usually the charge generation layer is applied onto the blocking layer and a charge transport layer is formed on the charge generation layer. This structure may have the charge generation layer on top of or below the charge transport layer.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like.

The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be between about 20 angstroms to about 750 angstroms, and more preferably from about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

An optional hole blocking layer may be applied to the substrate. Any suitable and conventional blocking layer capable of forming an electronic barrier to holes between the adjacent photoconductive layer and the underlying conductive surface of a substrate may be utilized.

An optional adhesive layer may be applied to the hole blocking layer. Any suitable adhesive layer well known in the art may be utilized. Typical adhesive layer materials include, for example, polyesters, polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

At least one electrophotographic imaging layer is formed on the adhesive layer, blocking layer or substrate. The electrophotographic imaging layer may be a single layer that performs both charge generating and charge transport functions as is well known in the art or it may comprise multiple layers such as a charge generator layer and charge transport layer. Charge generator layers may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge generator layers may also comprise inorganic pigments of crystalline selenium and its alloys; Group II–VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers utilizing infrared exposure systems. Infrared sensitivity is required for photoreceptors exposed to low cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms which have a strong influence on photogeneration.

Any suitable polymeric film forming binder material may be employed as the matrix in the charge generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition. The photogenerator layers can also fabricated by vacuum sublimation in which case there is no binder.

Any suitable and conventional technique may be utilized to mix and thereafter apply the photogenerating layer coating mixture. Typical application techniques include spraying, dip coating, roll coating, wire wound rod coating, vacuum sublimation and the like. For some applications, the generator layer may be fabricated in a dot or line pattern. Removing of the solvent of a solvent coated layer may be effected by any suitable conventional technique such as oven drying, infrared radiation drying, air drying and the like.

The charge transport layer may comprise a charge transporting small molecule dissolved or molecularly dispersed in a film forming electrically inert polymer such as a polycarbonate. The term "dissolved" as employed herein is defined herein as forming a solution in which the small molecule is dissolved in the polymer to form a homogeneous phase. The expression "molecularly dispersed" is used herein is defined as a charge transporting small molecule dispersed in the polymer, the small molecules being dispersed in the polymer on a molecular scale. Any suitable charge transporting or electrically active small molecule may be employed in the charge transport layer of this invention. The expression charge transporting "small molecule" is defined herein as a monomer that allows the free charge photogenerated in the transport layer to be transported across the transport layer. Typical charge transporting small molecules include, for example, pyrazolines such as 1-phenyl-3-(4'-diethylamino styryl)-5-(4"-diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis (4-N,N'-diethylaminophenyl)-1,2,4-oxadiazole, stilbenes and the like. However, to avoid cycle-up in machines with high throughput, the charge transport layer should be substantially free (less than about two percent) of triphenyl methane. As indicated above, suitable electrically active small molecule charge transporting compounds are dissolved or molecularly dispersed in electrically inactive polymeric film forming materials. A small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1'-biphenyl)-4,4'-diamine. If desired, the charge transport material in the charge transport layer may comprise a polymeric charge transport material or a combination of a small molecule charge transport material and a polymeric charge transport material.

Any suitable electrically inactive resin binder insoluble in the alcohol solvent used to apply the overcoat layer may be employed in the charge transport layer of this invention. Typical inactive resin binders include polycarbonate resin, polyester, polyarylate, polyacrylate, polyether, polysulfone, and the like. Molecular weights can vary, for example, from about 20,000 to about 150,000. Preferred binders include polycarbonates such as poly(4,4'-isopropylidene-diphenylene)carbonate (also referred to as bisphenol-A-polycarbonate, polycarbonate, poly(4,4'-cyclohexylidinediphenylene) carbonate (referred to as bisphenol-Z polycarbonate), poly(4,4'-isopropylidene-3,3'-dimethyl-diphenyl)carbonate (also referred to as bisphenol-C-polycarbonate) and the like. Any suitable charge transporting polymer may also be utilized in the charge transporting layer of this invention. The charge transporting polymer should be insoluble in the alcohol solvent employed to apply the overcoat layer of this invention. These electrically active charge transporting polymeric materials should be capable of supporting the injection of photogenerated holes from the charge generation material and be incapable of allowing the transport of these holes therethrough.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the charge transport layer is between about 10 and about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layers is preferably maintained from about 2:1 to 200:1 and in some instances as great as 400:1. The charge transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

The solution employed to form the overcoat layer of this invention comprises a hole transport material, an alcohol, polyvinyl butyral and a cross linkable polyamide film forming binder.

Any suitable hole insulating film forming alcohol soluble polyvinyl butyral film forming polymer may be employed in the overcoating of this invention. The expression "polyvinyl butyral", as employed herein, is defined as a copolymer or terpolymer obtained from the hydrolysis of polyvinyl acetate to form polyvinyl alcohol or a copolymer of polyvinyl alcohol with residual vinyl acetate groups, the resulting polyvinyl alcohol polymer being reacted with butyraldehyde under acidic conditions to form polyvinyl butyral polymers with various amounts of acetate, alcohol and butyraldehyde ketal groups. These polyvinyl butyral polymers are commercially available from, for example, Solutia Inc. with the trade names: BMS, BLS, BL1, B79, B99, and the like. These polymers differ in the amount of acetate, hydroxy, and butyraldehyde ketal groups contained therein. Generally, the weight average molecular weights of polyvinyl butyral film forming polymers vary from about 36000 to about 98000. A preferred alcohol soluble polyvinyl butyral film forming polymer can be represented by the following formula:

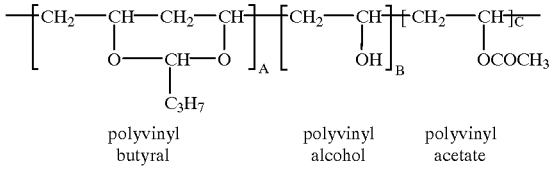

wherein

A is a number such that polyvinyl butyral content in the polymer is between about 50 and about 88 mol percent, B is a number such that polyvinyl alcohol content in the polymer is between about 12 and about 50 mol percent, and C is a number such that polyvinyl acetate content in the polymer is between about 0 and about 15 mol percent.

This polyvinyl butyral film forming polymer is the reaction product of a polyvinyl alcohol and butyraldehyde in the presence of a sulphuric acid catalyst. The hydroxyl groups of the polyvinyl alcohol react to give a random butyral structure which can be controlled by varying the reaction temperature and time. The acid catalyst is neutralized with potassium hydroxide. The polyvinyl alcohol is synthesized by hydrolyzing polyvinyl acetate. The resulting hydrolyzed polyvinyl alcohol may contain some polyvinyl acetate moieties. The partially or completely hydrolyzed polyvinyl alcohol is reacted with the butyraldehyde under conditions where some of the hydroxyl groups of the polyvinyl alcohol are reacted, but where some of the other hydroxyl groups of the polyvinyl alcohol remain unreacted. For utilization in the overcoating layer of this invention, the reaction product should have a polyvinyl butyral content of between about 50 and about 88 mol percent, a polyvinyl alcohol content of between about 12 mol percent and about 50 mol percent and a polyvinyl acetate content of between 0 and 15 mol percent. These film forming polymers are commercially available and include, for example, Butvar B-79 resin (available from Monsanto Chemical Co.) having a polyvinyl butyral content of about 70 mol percent, a polyvinyl alcohol content of 28 mol percent and a polyvinyl acetate content of less than about 2 mol percent, a weight average molecular weight of between about 50,000 and about 80,000; Butvar B-72 resin (available from Monsanto Chemical Co.) having a polyvinyl butyral content of about 56 mol percent by weight, a polyvinyl alcohol content of 42 mol percent and a polyvinyl acetate content of less than about 2 mol percent, a weight average molecular weight of between about 170,000 and about 250,000; and BMS resin (available from Sekisui Chemical) having a polyvinyl butyral content of about 72 mol percent, a vinyl acetate group content of about 5 mol percent, a polyvinyl alcohol content of 23 mol percent and a weight average of molecular weight of about 93,000. Preferably, the weight average molecular weight of the polyvinyl butyral utilized in the process of this invention is between about 40,000 and about 250,000. This polymer is described in U.S. Pat. No. 5,418,107, the entire disclosure thereof being incorporated herein by reference. The polyvinyl butyral is present in the final overcoating as tiny spheres dispersed in a matrix of the cross linked polyamide polymer. These spheres have an average particle size of between about 0.3 micrometer and about 1 micrometer. It is believed that the presence of the spheres leads to a high concentration of charge transport material in the matrix of the cross linked polyamide polymer which, in turn, leads to higher charge mobility. The overcoat of this invention preferably comprises between about 3 percent by weight and about 25 percent by weight of the polyvinyl butyral film forming polymer, based on the total weight of the overcoat after drying and cross linking of the cross linkable polyamide.

Any suitable hole insulating film forming alcohol soluble crosslinkable polyamide polymer having methoxy methyl groups attached to the nitrogen atoms of amide groups in the polymer backbone prior to crosslinking may be employed in the overcoating of this invention. A preferred alcohol soluble polyamide polymer having methoxy methyl groups attached to the nitrogen atoms of amide groups in the polymer backbone prior to crosslinking is selected from the group consisting of materials represented by the following Formulae I and II:

I

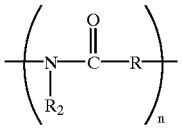

wherein:

n is a positive integer sufficient to achieve a weight average molecular weight between about 5000 and about 100,000, R is an alkylene unit containing from 1 to 12 carbon atoms, between 1 and 99 percent of the $R_2$ sites are —H, and the remainder of the $R_2$ sites are —$CH_2$—O—$CH_3$, and

II

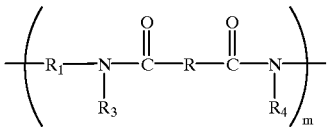

wherein:

m is a positive integer sufficient to achieve a weight average molecular weight between about 5000 and about 100000, $R_1$ and R are independently selected from the group consisting of alkylene units containing from 1 to 12 carbon atoms, and between 1 and 99 percent of the $R_3$ and $R_4$ sites are —H, and the remainder of the $R_3$ and $R_4$ sites are —$CH_2$—O—$CH_3$.

For R in Formula I, optimum results are achieved when the number of alkylene units containing less than 6 carbon atoms are about 40 percent of the total number of alkylene units. For R and $R_1$ in Formula II, optimum results are achieved when the number of alkylene units containing less than 6 carbon atoms are about 40 percent of the total number of alkylene units. Preferably, the alkylene unit R in polyamide Formula I is selected from the group consisting of $(CH_2)_4$ and $(CH_2)_6$, the alkylene units $R_1$ and R in polyamide Formula II are independently selected from the group consisting of $(CH_2)_4$ and $(CH_2)_6$, and the concentration of $(CH_2)_4$ and $(CH_2)_6$ is between about 40 percent and about percent of the total number of alkylene units in the polyamide of the polyamide of Formula I or the polyamide of Formula II. Between about 1 percent and about 50 mole percent of the total number of repeat units of the polyamide polymer should contain methoxy methyl groups attached to the nitrogen atoms of amide groups. These polyamides should form solid films if dried prior to crosslinking. The polyamide should also be soluble, prior to crosslinking, in the alcohol solvents employed.

A preferred polyamide is represented by the following formula:

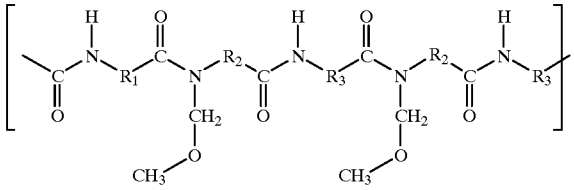

wherein $R_1$, $R_2$ and $R_3$ are alkylene units independently selected from units containing from 1 to 12 carbon atoms, and n is a positive integer sufficient to achieve a weight average molecular weight between about 5000 and about 100,000.

For $R_1$, $R_2$ and $R_3$ in formula appearing immediately above, optimum results are achieved when the number of alkylene units containing less than 6 carbon atoms are about 40 percent of the total number of alkylene units.

Typical alcohols in which the polyamide polymers having methoxy methyl groups attached to the nitrogen of amide groups in the polymer back bone prior to cross linking are soluble include, for example, butanol, ethanol, methanol, and the like and mixtures thereof. Typical alcohol soluble polyamide polymers having methoxy methyl groups attached to the nitrogen atoms of amide groups in the polymer backbone prior to crosslinking include, for example, hole insulating alcohol soluble polyamide film forming polymers such as Luckamide 5003 from Dai Nippon Ink, Nylon 8 with methylmethoxy pendant groups, CM4000 from Toray Industries, Ltd. and CM8000 from Toray Industries, Ltd. and other N-methoxymethylated polyamides, such as those prepared according to the method described in Sorenson and Campbell "Preparative Methods of Polymer Chemistry" second edition, pg. 76, John Wiley & Sons Inc. 1968, and the like and mixtures thereof. These polyamides can be alcohol soluble, for example, with polar functional groups, such as methoxy, ethoxy and hydroxy groups, pendant from the polymer backbone. It should be noted that polyamides, such as Elvamides from DuPont de Nemours & Co., do not contain methoxy methyl groups attached to the nitrogen atoms of amide groups in the polymer backbone. The overcoating layer of this invention preferably comprises between about 40 percent by weight and about 70 percent by weight of the crosslinked film forming crosslinkable alcohol soluble polyamide polymer having methoxy methyl groups attached to the nitrogen atoms of the amide groups in the polymer backbone, based on the total weight of the overcoating layer after crosslinking and drying. Crosslinking is accomplished by heating in the presence of a catalyst. Any suitable catalyst may be employed. Typical catalysts include, for example, oxalic acid, maleic acid, carbollylic acid, ascorbic acid, malonic acid, succinic acid, tartaric acid, citric acid, p-toluenesulfonic acid, methanesulfonic acid, and the like and mixtures thereof.

The coating composition for the overcoating of this invention may also comprise a cross linking accelerator. A preferred cross linking accelerator is trioxane. Trioxane is represented by the following structural formula:

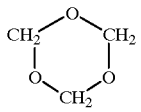

Trioxane functions as a source of formaldehyde by reacting with acids such as oxalic acid in the overcoat formulation with Luckamide. The Luckamide is a Nylon 6 polymer with methoxymethyl groups and some amide groups. It is believed that the amide groups on the Nylon 6 react with formaldehyde generated from the trioxane to form crosslinking sites with amide groups on other Nylon 6 polymer chains. Trioxane improves the BCR wear resistance of the Luckamide coating because crosslinking occurs more predictably and at a faster rate than when Luckamide is crosslinked without trioxane. Other accelerators can also be used. These include, for example, Cymel 303 (available from American Cyanamid). Cymel 303 is a methoxymethylated melamine compound with the formula, [(CH3OCH2) 6N3C3N3] or following structural formula

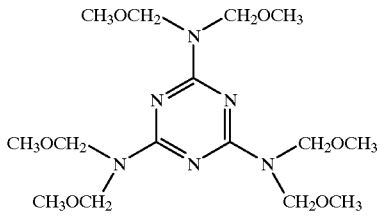

It is believed that the Cymel 303 crosslinks Nylon-6 amide groups by displacing methanol from methoxymethyl groups.

The temperature used for crosslinking varies with the specific catalyst and heating time utilized and the degree of crosslinking desired. Generally, the degree of crosslinking selected depends upon the desired flexibility of the final photoreceptor. For example, complete crosslinking may be used for rigid drum or plate photoreceptors. However, partial crosslinking is preferred for flexible photoreceptors having, for example, web or belt configurations. The degree of crosslinking can be controlled by the relative amount of catalyst employed. The amount of catalyst to achieve a desired degree of crosslinking will vary depending upon the specific polyamide, catalyst, temperature and time used for the reaction. Preferably, a polyamide is cross linked at a temperature between about 1 00° C. and about 150° C. A typical cross linking temperature used for Luckamide with oxalic acid as a catalyst is about 125° C. for about 30 minutes. A typical concentration of oxalic acid is between about 5 and about 10 weight percent based on the weight of Luckamide. A typical concentration of trioxane is between about 5 and about 10 weight percent based on the weight of Luckamide. After crosslinking, the overcoating should be substantially insoluble in the solvent in which it was soluble prior to crosslinking. Thus, no overcoating material will be removed when rubbed with a cloth soaked in the solvent. Crosslinking results in the development of a three dimensional network which restrains the hydroxy functionalized transport molecule as a fish is caught in a gill net.

Any suitable alcohol solvent may be employed for the film forming polyamides. Typical alcohol solvents include, for example, butanol, propanol, methanol, and the like and mixtures thereof.

Any suitable hole transport material may be utilized in the overcoating layer of this invention. Preferably, the hole transport material is an alcohol soluble polyhydroxy diaryl amine small molecule charge transport material having at least two hydroxy functional groups. An especially preferred small molecule hole transporting material can be represented by the following formula:

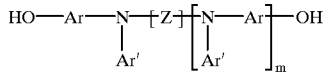

wherein:

m is 0 or 1,

Z is selected from the group consisting of:

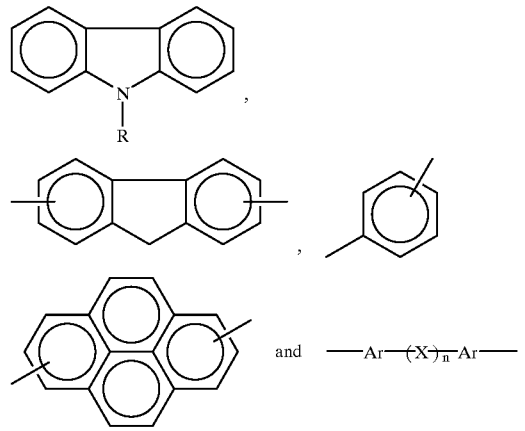

n is 1 or 1,

Ar is selected from the group consisting of:

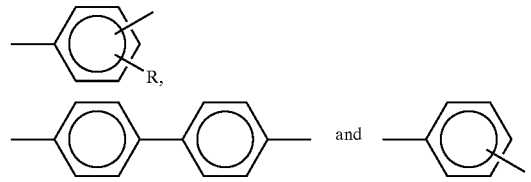

R is selected from the group consisting of —$CH_3$, —$C_2H_5$, —$C_3H_7$, and —$C_4H_9$, Ar' is selected from the group consisting of:

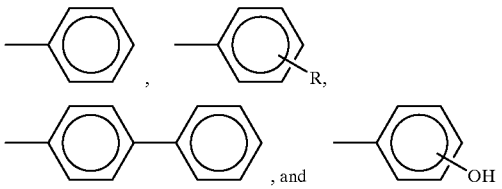

X is selected from the group consisting of:

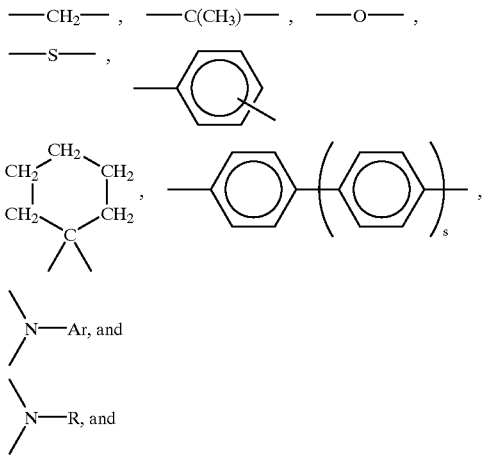

s is 0,1 or 2, the dihydroxy arylamine compound being free of any direct conjugation between the —OH groups and the nearest nitrogen atom through one or more aromatic rings.

The expression "direct conjugation" is defined as the presence of a segment, having the formula:

$$—(C{=}C)_n—C{=}C—$$

in one or more aromatic rings directly between an —OH group and the nearest nitrogen atom. Examples of direct conjugation between the —OH groups and the nearest nitrogen atom through one or more aromatic rings include a compound containing a phenylene group having an —OH group in the ortho or para position (or 2 or 4 position) on the phenylene group relative to a nitrogen atom attached to the phenylene group or a compound containing a polyphenylene group having an —OH group in the ortho or para position on the terminal phenylene group relative to a nitrogen atom attached to an associated phenylene group.

Typical polyhydroxy arylamine compounds utilized in the overcoat of this invention include, for example: N,N'-diphenyl-N,N'-bis(3-hydroxyphenyl)-[1,1'-biphenyl]-4,4'-diamine; N,N,N',N',-tetra(3-hydroxyphenyl)-[1,1'-biphenyl]-4,4'-diamine; N,N-di(3-hydroxyphenyl)-m-toluidine; 1,1-bis-[4-(di-N,N-m-hydroxyphenyl)-aminophenyl]-cyclohexane; 1,1-bis[4-(N-m-hydroxyphenyl)-4-(N-phenyl)-aminophenyl]-cyclohexane; bis-(N-(3-hydroxyphenyl)-N-phenyl-4-aminophenyl)-methane; bis[(N-(3-hydroxyphenyl)-N-phenyl)-4-aminophenyl]-isopropylidene; N,N'-diphenyl-N,N'-bis(3-hydroxyphenyl)-[1,1'4',1"-terphenyl]-4,4"-diamine; 9-ethyl-3.6-bis[N-phenyl-N-3(3-hydroxyphenyl)-amino]-carbazole; 2,7-bis[N,N-di(3-hydroxyphenyl)-amino]-fluorene; 1,6-bis[N,N-di(3-hydroxyphenyl)-amino]-pyrene; 1,4-bis[N-phenyl-N-(3-hydroxyphenyl)]-phenylenediamine.

Optionally, a deletion control agent may be present in the overcoat. The deletions can occur due to the oxidation effects of the corotron or bias charging roll (BCR) effluents that increases the conductivity of the photoreceptor surface. The deletion control agents minimize this conductivity change. A class of deletion control agents that is effective includes triphenyl methanes with nitrogen containing substituents such as bis-(2-methyl-4-diethylaminophenyl)-phenylmethane and the like. Other deletion control agents include, for example, hindered phenols such as butylated hydroxy toluene and the like. Alcohol soluble deletion control agents can be added directly into the coating solution. Alcohol insoluble deletion control agents can first be dissolved in non alcohol solvent such as tetrahydrafuran, monochloro benzene or the like and mixtures thereof and then added to the overcoat solution.

All the components utilized in the overcoating solution of this invention should be soluble in the mixture of alcohol and non-alcoholic bis-(2-methyl-4-diethylaminophenyl)-phenylmethane solvents employed for the overcoating. When at least one component in the overcoating mixture is not soluble in the solvent utilized, phase separation can occur which would adversely affect the transparency of the overcoating and electrical performance of the final photoreceptor. Generally, the percentage of total solids of the components in the overcoating solution of this invention is hydroxy arylamine compound: 35.9 to 44.6 percent of total solids; bis-(2-methyl-4-diethylaminophenyl)-phenylmethane: 2.8 to 5.4 percent of total solids; formaldehyde source: 2.5 to 4.9 percent of total solids; polyvinyl butyral: 15 to 16.2 percent of total solids; polyamide: 35 to 37.7 percent of total solids. The total solids concentration in the overcoating solution of this invention is 15.2 to 17.8 weight percent. However, the specific amounts can vary depending upon the specific polyamide, polyvinyl butyral, formaldehyde source, alcohol and bis-(2-methyl-4-diethylaminophenyl)-phenylmethane : bis-(2-methyl-4-diethylaminophenyl)-phenylmethane non-alcoholic solvent selected. Preferably, the solvent mixture contains between about 85 percent and about 99 percent by weight of alcohol and between about 1 percent and about 15 percent by weight of bis-(2-methyl-4-diethylaminophenyl)-phenylmethane non-alcoholic solvent, based on the total weight of the solvents in the overcoat coating solution. A typical composition comprises 0.7 gram Luckamide, 0.3 gram BMS, 0.9 gram DHTBD, 0.1 gram bis-(2-methyl-4-diethylaminophenyl)-phenylmethane, 5.43 grams methanol, 5.43 grams 1-propanol, 0.4 gram tetrahydrofuran, 0.08 gram oxalic acid and 0.075 gram trioxane.

Various techniques may be employed to form coating solutions containing bis-(2-methyl-4-diethylaminophenyl)-phenylmethane, polyamide and polyhydroxy diaryl amine small molecule. For example, the preferred technique is to dissolve bis-(2-methyl-4-diethylaminophenyl)-phenylmethane in a suitable alcohol soluble solvent such as tetrahydrofuran prior to mixing with a solution of polyhydroxy diaryl amine (e.g. N,N'-diphenyl-N,N'-bis(3-hydroxyphenyl)-[1,1'-biphenyl]-4,4'-diamine) and polyamide in alcohol. Alternatively, from about 5 percent to about 20 percent (by weight, based on the total weight of solvents) of a co-solvent, such as chlorobenzene, may be mixed with polyhydroxy diaryl amine (e.g. N,N'-diphenyl-N,N'-bis(3-hydroxyphenyl)-[1,1'-biphenyl]-4,4'-diamine) and polyamide dissolved in alcohol followed by dissolving, with warming, bis-(2-methyl-4-diethylaminophenyl)-phenylmethane in the coating solution. Good films have been coated using these methods. Deletion testing of these compositions have shown that they perform equally well as bis-[2-methyl-4-(N-2-hydroxyethyl-N-ethyl-aminophenyl)]-phenylmethane at the same concentrations, such as at 10 weight percent N,N'-diphenyl-N,N'-bis(3-hydroxyphenyl)-[1,1'-biphenyl]-4,4'-diamine [DHTBD]. N,N'-diphenyl-N,N'-bis(3-hydroxyphenyl)-[1,1'-biphenyl]-4,4'-diamine, can be represented by the following formula:

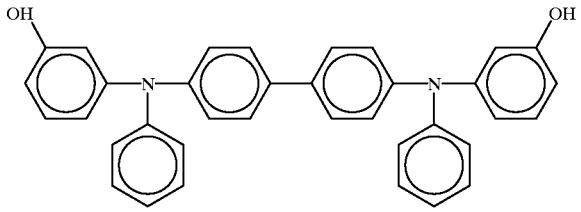

Bis-[2-methyl-4-(N-2-hydroxyethyl-N-ethylaminophenyl)]-phenylmethane (DHTPM) can be represented by the following formula:

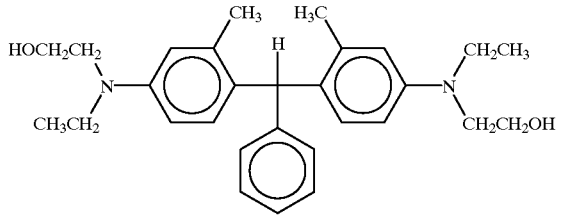

The thickness of the continuous overcoat layer selected depends upon the abrasiveness of the charging (e.g., bias charging roll), cleaning (e.g., blade or web), development (e.g., brush), transfer (e.g., bias transfer roll), etc., in the system employed and can range up to about 10 micrometers. A thickness of between about 1 micrometer and about 5 micrometers in thickness is preferred. Any suitable and conventional technique may be utilized to mix and thereafter apply the overcoat layer coating mixture to the charge generating layer. Typical application techniques include spraying, dip coating, roll coating, wire wound rod coating, and the like. Drying of the deposited coating may be effected by any suitable conventional technique such as oven drying, infrared radiation drying, air drying and the like. The dried overcoating of this invention should transport holes during imaging and should not have too high a free carrier concentration. Free carrier concentration in the overcoat increases the dark decay. Preferably the dark decay of the overcoated layer should be about the same as that of the unovercoated device.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

Electrophotographic imaging members were prepared by applying by dip coating a charge blocking layer onto the rough surface of eight aluminum drums having a diameter of 3 cm and a length of 31 cm. The blocking layer coating mixture was a solution of 8 weight percent polyamide (nylon 6) dissolved in a 92 weight percent butanol, methanol and water solvent mixture. The butanol, methanol and water mixture percentages were 55, 36 and 9 percent by weight, respectively. The coating was applied at a coating bath withdrawal rate of 300 millimeters/minute. After drying in a forced air oven, each blocking layers had a thickness of 1.5 micrometers. The dried blocking layers were coated with a charge generating layer containing 2.5 weight percent hydroxy gallium phthalocyanine pigment particles, 2.5 weight percent polyvinylbutyral film forming polymer and 95 weight percent cyclohexanone solvent. The coatings were applied at a coating bath withdrawal rate of 300 millimeters/minute. After drying in a forced air oven, each charge generating layer had a thickness of 0.2 micrometer. The drums were subsequently coated with charge transport layers containing N,N'-diphenyl-N,N'-bis(3-methylphenyl)-1,1;-biphenyl-4,4'-diamine dispersed in polycarbonate binder (PCZ300, available from the Mitsubishi Chemical Company). The charge transport coating mixture consisted of 8 weight percent N,N'-diphenyl-N,N'-bis(3-methylphenyl)-1,1'-biphenyl-4,4;-diamine, 12 weight percent binder and 80 weight percent monochlorobenzene solvent. The coatings were applied in a Tsukiage dip coating apparatus. After drying in a forced air oven for 45 minutes at 118 C, each transport layer had a thickness of 20 micrometers.

EXAMPLE II

Drums of Example I was overcoated with an overcoat layer coating composition of this invention. This composition was prepared by mixing N,N'-diphenyl-N,N'-bis(3-hydroxyphenyl)-[1,1'-biphenyl]-4,4'-diamine (DHTBD: a hydroxy functionalized aromatic diamine), polyamide (Luckamide 5003, available from Dai Nippon Ink) and polyvinyl butyral (BMS, available from Sekisui Chemical ). More specifically, 0.7 gram of a 7 percent weight solution of Luckamide 5003 and 0.3 gram of a 3 percent weight solution of BMS in a 50:50 weight ratio solvent of methanol and propanol and 1.0 gram of N,N'-diphenyl-N,N'-bis(3-hydroxyphenyl)-[1,1'-biphenyl]-4,4'-diamine were roll milled for 2 hours. To this was added 0.1 gram of bis-(2-methyl-4-diethylaminophenyl)-phenylmethane [BDETPM] mixed in 0.4 gram of tetrahydrofuran, and then allowed to stand for several hours before use. 0.08 grams of oxalic acid and 0.075 gram of trioxane were then added to the mixture. A 6 micrometer thick overcoat was applied in the dip coating apparatus with a pull rate of 250 millimeters/min. The overcoated drum was dried at 120° C. for 35 minutes. The photoreceptor was print tested in a Xerox 3321 machine for 500 consecutive prints. There was no loss of image sharpness, no problem with background or any other defect resulting from the overcoats.

EXAMPLE III

An unovercoated drum of Example I and an overcoated drum of Example II were tested in a wear fixture that contained a bias charging roll for charging. Wear was calculated in terms of nanometers/kilocycles of rotation (nm/Kc). Reproducibility of calibration standards was about ±2 nm/Kc. The wear of the drum without the overcoat of Example I was greater than 80 nm/Kc. Wear of the overcoated drums of this invention of Example II was between 10 and 20 nm/Kc. Thus, the improvement in resistance to wear for the photoreceptor of this invention, when subjected to bias charging roll cycling conditions, was very significant, i.e. wear for the unovercoated photoreceptor was at least 300 percent greater than the overcoated drum of this invention.

EXAMPLE IV

An unovercoated drum of Example I was overcoated with a cross linked overcoat layer material described in Example III of U.S. application Ser. No. 09/218,928 (Attorney Docket No. D/98713) filed in the names of Renfer et al., entitled "IMPROVED STABILIZED OVERCOAT COMPOSITIONS", filed on Dec. 22, 1998, the entire disclosure thereof being incorporated herein by reference. The overcoat layer was prepared by mixing 1 gram of a 10 percent by weight solution of polyamide containing methoxymethyl groups (Luckamide 5003, available from Dai Nippon Ink) in a 90:10 weight ratio solvent of methanol and n-propanol and 1.0 gram N,N'-diphenyl-N,N'-bis(3-hydroxyphenyl)-[1,1'-biphenyl]-4,4'-diamine [a hydroxy functionalized aromatic diamine (DHTBD)], and a 0.5 gram solution with 0.1 gram bis-(2-methyl-4-diethylaminophenyl)-phenylmethane [BDETPM] dissolved in 0.4 gram tetrahydrofuran in a roll mill for 2 hours. Immediately prior to application of the overcoat layer mixture, 0.08 gram of oxalic acid was added and the resulting mixture was roll milled briefly to assure dissolution. This coating solution was applied to the photoreceptor using a dip coating apparatus to obtain a 6 micrometer thick coating after drying. This overcoat layer was air dried in a hood for 15 minutes. The air dried film was then dried in a forced air oven at 120° C. for 30 minutes.

EXAMPLE V

An overcoated drum of Example IV and an overcoated drum of Example II were is tested for adhesion between the overcoat layer and the charge transport layer. Adhesion was measured in grams per centimeter using a using a model 3M90 step peel tester, an instrument made by Instrumentors Inc. Adhesion between overcoat layer and charge transport layer of the drum of Example IV (of the prior art) was between 9 and 13 grams per centimeter. Such small values of adhesion result in partial peeling of the overcoat layer from the charge transport layer during testing with the wear process described in Example III. Adhesion between the overcoat layer and charge transport layer of the drum of Example II of this invention was between 21 and 30 grams per centimeter. Such values of adhesion ensure no peeling of overcoat layer from transport layer during a wear process described in Example III. Thus, the improvement in adhesion to the transport layer for the photoreceptor of this invention was very significant.

EXAMPLE VI

Charge carrier mobilities were measured in the overcoat of this invention (Example II) and the overcoat of Example IV. Charge carrier mobilities were measured by the time of flight technique. In the time of flight technique, a flash of light photogenerates a sheet of holes, the transit of the holes through the transport layer and the overcoat being time resolved. An electroded device was prepared (the aluminum drum was a bottom electrode and a vacuum deposited semitransparent gold was a top electrode) and then biased with a negative polarity voltage source. The mobility was calculated from the transit time by the relationship:

$$\text{Mobility}=(\text{overcoat thickness})/(\text{transit time}\times\text{Electric field}).$$

The measured mobilities are shown in the following table:

| Electric Field | Overcoat of Example II | Overcoat of Example IV |
|---|---|---|
| 10 Volts/micrometer | 2.5 e-8 | 9.8 e-9 |
| 20 Volts/micrometer | 4.4 e-8 | 1.7 e-8 |

The mobility in the overcoat of this invention was over a factor 2.5 higher than the overcoat of the overcoat of Example IV. This was a very significant increase and it was unexpected . This higher mobility allows for the use of thicker overcoats for equivalent residual potentials.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. An electrophotographic imaging member comprising
a substrate,
a charge generating layer,
a charge transport layer, and
an overcoat layer comprising
a polyvinyl butyral film forming binder,
a cross linked polyamide film forming binder, and
a hole transport material.

2. An electrophotographic imaging member according to claim 1 wherein the polyamide film forming binder prior to cross linking is a crosslinkable alcohol soluble polyamide polymer having methoxy methyl groups attached to nitrogen atoms of amide groups in the polyamide backbone.

3. An electrophotographic imaging member according to claim 1 wherein the overcoat layer comprises between about 3 percent by weight and about 25 percent by weight of the polyvinyl butyral film forming binder and between about 40 percent by weight and about 70 percent by weight of the cross linked polyamide film forming binder, based on the total weight of the overcoat layer.

4. An electrophotographic imaging member according to claim 1 wherein the polyvinyl butyral film forming binder comprises a polymer represented by the formula:

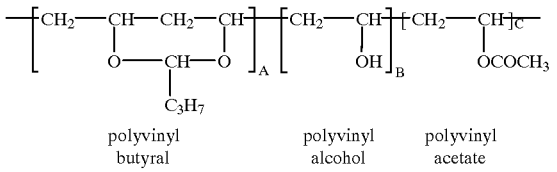

wherein:

A is a number such that polyvinyl butyral content in the polymer is about 50 and about 88 mol percent, B is a number such that polyvinyl alcohol content in the polymer is between about 12 and about 50 mol percent, and C is a number such that polyvinyl acetate content in the polymer is between about 0 and about 15 mol percent.

5. An electrophotographic imaging member according to claim 1 wherein the hole transport material is an alcohol soluble polyhydroxy diarylamine.

6. An electrophotographic imaging member according to claim 5 wherein the hole transport material is an alcohol soluble N,N'-diphenyl-N,N'-bis(3-hydroxyphenyl)-[1,1'-biphenyl]-4,4'-diamine represented by the formula:

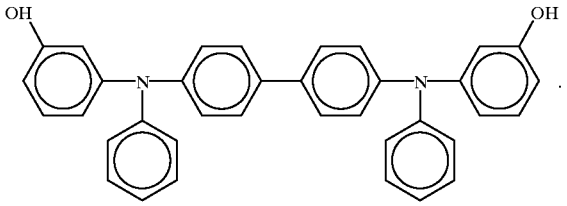

7. An electrophotographic imaging member according to claim 1 wherein the overcoat layer also comprises a deletion control agent.

8. An electrophotographic imaging member according to claim 7 wherein the deletion control agent is bis-(2-methyl-4-diethylaminophenyl)-phenylmethane.

9. An electrophotographic imaging member according to claim 1 wherein the overcoat layer prior to cross linking of the cross linked polyamide film forming binder also comprises a catalyst selected from the group consisting of oxalic acid, maleic acid, carbollylic acid, ascorbic acid, malonic acid, succinic acid, tartaric acid, citric acid, p-toluenesulfonic acid, methanesulfonic acid, and mixtures thereof.

10. An electrophotographic imaging member according to claim 1 wherein the overcoat layer prior to cross linking of the cross linked polyamide film forming binder also comprises a cross linking accelerator selected from the group consisting of trioxane, methoxymethylated melamine compounds and mixtures thereof that further accelerate cross linking.

11. An electrophotographic imaging member according to claim 1 wherein the polyvinyl butyral film forming binder is present in the overcoat layer as tiny spheres dispersed within a matrix of the cross linked polyamide polymer.

12. An electrophotographic imaging member according to claim 11 wherein the tiny spheres have an average particle size of between about 0.3 micrometer and about 1 micrometer.

13. A process comprising forming a coating solution comprising
- an alcohol miscible nonalcoholic solvent,
- a hole transporting material,
- an alcohol,
- a polyvinyl butyral film forming binder, and
- a cross linkable polyamide film forming binder, forming a coating with the coating solution on a photoreceptor comprising
- a charge generating layer and
- a charge transport layer, and drying the coating and cross linking the polyamide to form an overcoat layer.

14. A process according to claim 13 wherein the coating solution also comprises bis-(2-methyl-4-diethylaminophenyl)-phenylmethane dissolved in the alcohol miscible nonalcoholic solvent.

15. A process according to claim 14 including forming the coating solution by dissolving bis-(2-methyl-4-diethylaminophenyl)-phenylmethane in the alcohol miscible nonalcoholic solvent for bis-(2-methyl-4-diethylaminophenyl)-phenylmethane prior to combination with the hole transporting molecule, the alcohol and the cross linkable polyamide film forming binder.

16. A process according to claim 13 wherein the nonalcoholic solvent is selected from the group consisting of tetrahydrofuran, chlorobenzene and mixtures thereof.

17. A process according to claim 13 wherein the cross linkable polyamide film forming binder is a polyamide polymer having methoxy methyl groups attached to the nitrogen atoms of amide groups in the polymer backbone prior to cross linking.

18. A process according to claim 13 wherein the alcohol is selected from the group consisting of methanol, ethanol, butanol and mixtures thereof.

19. A process according to claim 13 including cross linking the polyamide with a catalyst and heat.

20. A process according to claim 13 wherein the drying and cross linking comprises heating the coating at a temperature between about 100° C. and about 150° C.

21. A process according to claim 13 wherein the overcoating layer comprises between about 3 percent by weight and about 25 percent by weight of the polyvinyl butyral film forming binder and between about 40 percent by weight and about 70 percent by weight of the cross linked polyamide film forming binder, based on the total weight of the overcoat layer after drying and cross linking of the polyamide.

22. A process according to claim 13 wherein the polyvinyl butyral film forming binder comprises a polymer represented by the formula:

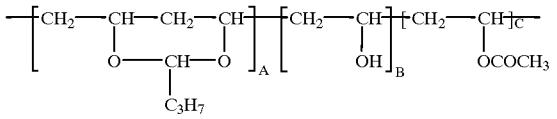

polyvinyl butyral — polyvinyl alcohol — polyvinyl acetate wherein:

A is a number such that polyvinyl butyral content in the polymer is about 50 and about 88 mol percent, B is a number such that polyvinyl alcohol content in the polymer is between about 12 and about 50 mol percent, and C is a number such that polyvinyl acetate content in the polymer is between about 0 and about 15 mol percent.

23. A process according to claim 13 wherein the charge transport layer is substantially free of triphenyl methane.

24. A process according to claim 13 wherein the charge transport layer comprises a hole transport material and a polycarbonate film forming binder, the polycarbonate film forming binder being insoluble in the alcohol in the coating solution used to form the overcoating layer.

* * * * *